US010089865B2

(12) United States Patent
Okazaki et al.

(10) Patent No.: US 10,089,865 B2
(45) Date of Patent: Oct. 2, 2018

(54) ONBOARD SYSTEM AND MONITORING SYSTEM

(71) Applicant: MITSUBISHI HEAVY INDUSTRIES MECHATRONICS SYSTEMS, LTD., Kobe-shi, Hyogo (JP)

(72) Inventors: Takuma Okazaki, Tokyo (JP); Ryota Hiura, Tokyo (JP)

(73) Assignee: MITSUBISHI HEAVY INDUSTRIES MACHINERY SYSTEMS, LTD., Hyogo (JP)

( * ) Notice: Subject to any disclaimer, the term of this patent is extended or adjusted under 35 U.S.C. 154(b) by 0 days.

(21) Appl. No.: 15/512,050

(22) PCT Filed: Sep. 19, 2014

(86) PCT No.: PCT/JP2014/074904
§ 371 (c)(1),
(2) Date: Mar. 16, 2017

(87) PCT Pub. No.: WO2016/042669
PCT Pub. Date: Mar. 24, 2016

(65) Prior Publication Data
US 2017/0278387 A1 Sep. 28, 2017

(51) Int. Cl.
*G08G 1/01* (2006.01)

(52) U.S. Cl.
CPC ..... *G08G 1/0125* (2013.01)

(58) Field of Classification Search
CPC .... G08G 1/0125; G08G 1/015; G07B 15/063; G07B 15/00; G06Q 2240/00
See application file for complete search history.

(56) References Cited

U.S. PATENT DOCUMENTS 6,590,506 B1 * 7/2003 Oouchi ..... G07B 15/063 235/384
2005/0237223 A1 * 10/2005 Nishiwaki ..... G07B 15/063 340/928
2010/0001904 A1 * 1/2010 Iwamatsu ..... H01Q 3/2611 342/372

(Continued)

FOREIGN PATENT DOCUMENTS

JP 9-62881 A 3/1997
JP 2000-149078 A 5/2000

(Continued)

OTHER PUBLICATIONS

Translation of JP2009035065.*

(Continued)

*Primary Examiner* — Brian Zimmerman
*Assistant Examiner* — Sara Samson
(74) *Attorney, Agent, or Firm* — Kanesaka Berner and Partners LLP

(57) ABSTRACT

An onboard system installed in a vehicle that performs traffic processing for the vehicle, the onboard system comprising an onboard unit that communicates with an external device to perform charge processing; and a notification device that outputs a notification signal to an external device according to whether an expected onboard unit is connected or the expected onboard unit is disconnected via a connection unit connectable to the onboard unit.

8 Claims, 9 Drawing Sheets

(56) References Cited

U.S. PATENT DOCUMENTS

| | | | | |
|---|---|---|---|---|
| 2012/0232964 | A1* | 9/2012 | Brands | G07B 15/063 705/13 |
| 2015/0058224 | A1* | 2/2015 | Gaddam | G06Q 20/327 705/44 |
| 2016/0036586 | A1* | 2/2016 | Murakami | G07B 15/063 380/270 |
| 2016/0300401 | A1* | 10/2016 | Povolny | G08G 1/017 |

FOREIGN PATENT DOCUMENTS

| | | | | |
|---|---|---|---|---|
| JP | 2002-24880 | A | | 1/2002 |
| JP | 2002-24887 | A | | 1/2002 |
| JP | 2002-133480 | A | | 5/2002 |
| JP | 2009-35065 | A | | 2/2009 |
| JP | 2009035065 | A | * | 2/2009 |
| JP | 2009-199413 | A | | 9/2009 |
| KR | 10-2009-0061386 | A | | 6/2009 |

OTHER PUBLICATIONS

International Search Report in International Patent Application No. PCT/JP2014/074904, dated Nov. 18, 2014.
Written Opinion in International Patent Application No. PCT/JP2014/074904, dated Nov. 18, 2014.

* cited by examiner

ONBOARD SYSTEM AND MONITORING SYSTEM

RELATED APPLICATIONS

The present application is a National Phase of International Application Number PCT/JP2014/074904, filed Sep. 19, 2014.

TECHNICAL FIELD

The present invention relates to an onboard system and a monitoring system.

BACKGROUND ART

Systems are known whereby when a vehicle equipped with an onboard unit passes through a tollgate, a roadside antenna device provided at the tollgate and the onboard unit communicate via dedicated short-range communication (DSRC), and, on the basis of the communication result, a toll amount is determined. In such a system, when a communication result from communication between the roadside antenna device and the onboard unit cannot be obtained, it is determined that the cause may be that the onboard unit has been disconnected from the vehicle, and an image of the vehicle equipped with the onboard unit is transmitted to a data center. From this image, the toll infringing vehicle can be caught.

An onboard unit is known with an object of preventing theft and fraudulent exchange of onboard units. When the onboard unit detects that the onboard unit is disconnected from the vehicle, information on the detection is stored in memory. When wireless communication between the onboard unit and the roadside antenna is established, information on the detection of the attachment/removal of the onboard unit is read from the memory and transmitted (see Patent Document 1, for example).

Another known onboard unit with an object of preventing switching between vehicles, does not allow transmission of information outside the vehicle when the onboard unit is detected to have been removed from the inside of the vehicle, and controls the charge processing on the basis of the communication result with the roadside antenna (see Patent Document 2, for example).

CITATION LIST

Patent Documents

Patent Document 1: Japanese Unexamined Patent Application Publication No. 2002-24887A Patent Document 2: Japanese Unexamined Patent Application Publication No. H09-62881A

SUMMARY OF INVENTION

Technical Problem

However, the accuracy of DSRC communication is not 100% perfect and communication errors may occur. In such cases, a vehicle with a properly attached onboard unit may be falsely determined as a vehicle with a fraudulently disconnected onboard unit. Also, there are cases in which vehicle with a different onboard unit successfully communicates via DSRC communication and is not charged the full toll amount. As such, fraudulent vehicles cannot always be caught just by the communication result of the DSRC communication.

Solution to Problem

An aspect of the present invention is an onboard system (1, 2) installed in a vehicle that performs traffic processing for the vehicle, the onboard system (1, 2) comprising an onboard unit (10, 12) that communicates with an external device to perform charge processing; and a notification device (20) that outputs a notification signal to an external device according to whether an expected onboard unit is connected or the expected onboard unit is disconnected via a connection unit (201) connectable to the onboard unit.

This configuration allows the notification signal output to an external device to be verified, and whether the expected onboard unit is connected or not connected to be identified.

According to an aspect of the present invention, the notification device determines a connected status with the onboard unit or a disconnected status with the onboard unit on the basis of a signal regularly outputted from the onboard unit, and outputs a notification signal on the basis of a determination result.

According to this configuration, whether there is a connected status or a disconnected status with the onboard unit can be easily determined.

According to an aspect of the present invention, the notification device stores first vehicle information on the vehicle, and compares the first vehicle information with second vehicle information stored in the onboard unit and outputs the notification signal to an external device if the first and second vehicle information do not match.

According to this configuration, if the first vehicle information and the second vehicle information do not match, a notification signal is output to an external device, thus allowing a fraudulent vehicle with an onboard unit from another vehicle to be discovered. Additionally, if there is no second vehicle information, a notification signal is output to an external device, thus allowing a fraudulent vehicle with a disconnected onboard unit to be discovered.

According to an aspect of the present invention, the notification device emits a preset pattern of light as the notification signal.

According to this configuration, image processing or visual verification of light emitting in a preset pattern enables a fraudulent vehicle to be discovered.

An aspect of the present invention is a monitoring system, comprising the onboard system according to any one of aspects above; and a monitoring device (60) that monitors a notification signal emitted from a notification device of the onboard system.

According to this configuration, the output notification signal is monitored, enabling a fraudulent vehicle without the onboard unit to be easily discovered from multiple vehicles passing through a tollgate or charge point.

According to an aspect of the present invention, the monitoring device comprises a camera (603) that captures an image of a vehicle equipped with the notification device that is outputting the notification signal.

According to this configuration, a fraudulent vehicle outputting a notification signal can be discovered on the basis of an image captured by the camera, and the captured image becomes evidence used to catch such vehicles with no onboard unit or a switched unexpected onboard unit.

According to an aspect of the present invention, the monitoring device detects whether or not the notification device is emitting a light from an image captured by the camera.

According to this configuration, the fraudulent vehicles without the onboard unit or a different switched onboard unit can be extracted from the captured image. As a result, the work involved in catching fraudulent vehicles is reduced.

According to an aspect of the present invention, the monitoring device extracts number information of a vehicle from an image captured by the camera, and obtains, from the number information, number information that is extracted from the image in which a notification signal from the notification device is detected as information to identify a fraudulent vehicle.

According to this configuration, a fraudulent vehicle without the onboard unit or a fraudulent vehicle with a switched unexpected onboard unit can be identified from the number information.

Advantageous Effects of Invention

Fraudulent vehicle can be detected.

DESCRIPTION OF EMBODIMENTS

First Embodiment

An example of an onboard system 1 according to an embodiment of the present invention will be described below.

Onboard System 1

Figure 1:
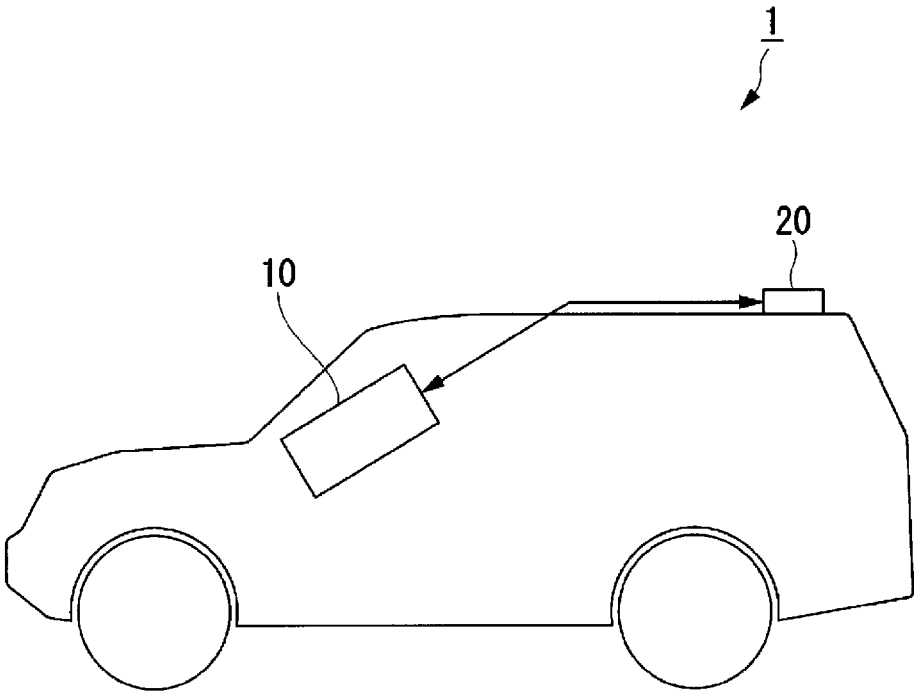
FIG. 1 is a schematic diagram illustrating an example of an onboard system 1 according to an embodiment of the present invention.

FIG. 1 is a schematic diagram illustrating an example of an onboard system 1 according to an embodiment of the present invention. As illustrated in FIG. 1, the onboard system 1 is installed in a vehicle and includes an onboard unit 10 and a notification device 20.

The onboard unit 10 is installed inside and to the front of the vehicle, for example near the front glass. When the vehicle passes through a tollgate of a toll road, the onboard unit 10 performs charge processing on the basis of a DSRC communication result.

The notification device 20 is installed outside and on the top portion of the vehicle, for example near the rear glass. The notification device 20 is electrically connected to the onboard unit 10.

In this embodiment, the onboard unit 10 is installed in a discretionary attachment position inside the vehicle to be electrically connected to the notification device 20.

Overall Configuration

Figure 2:
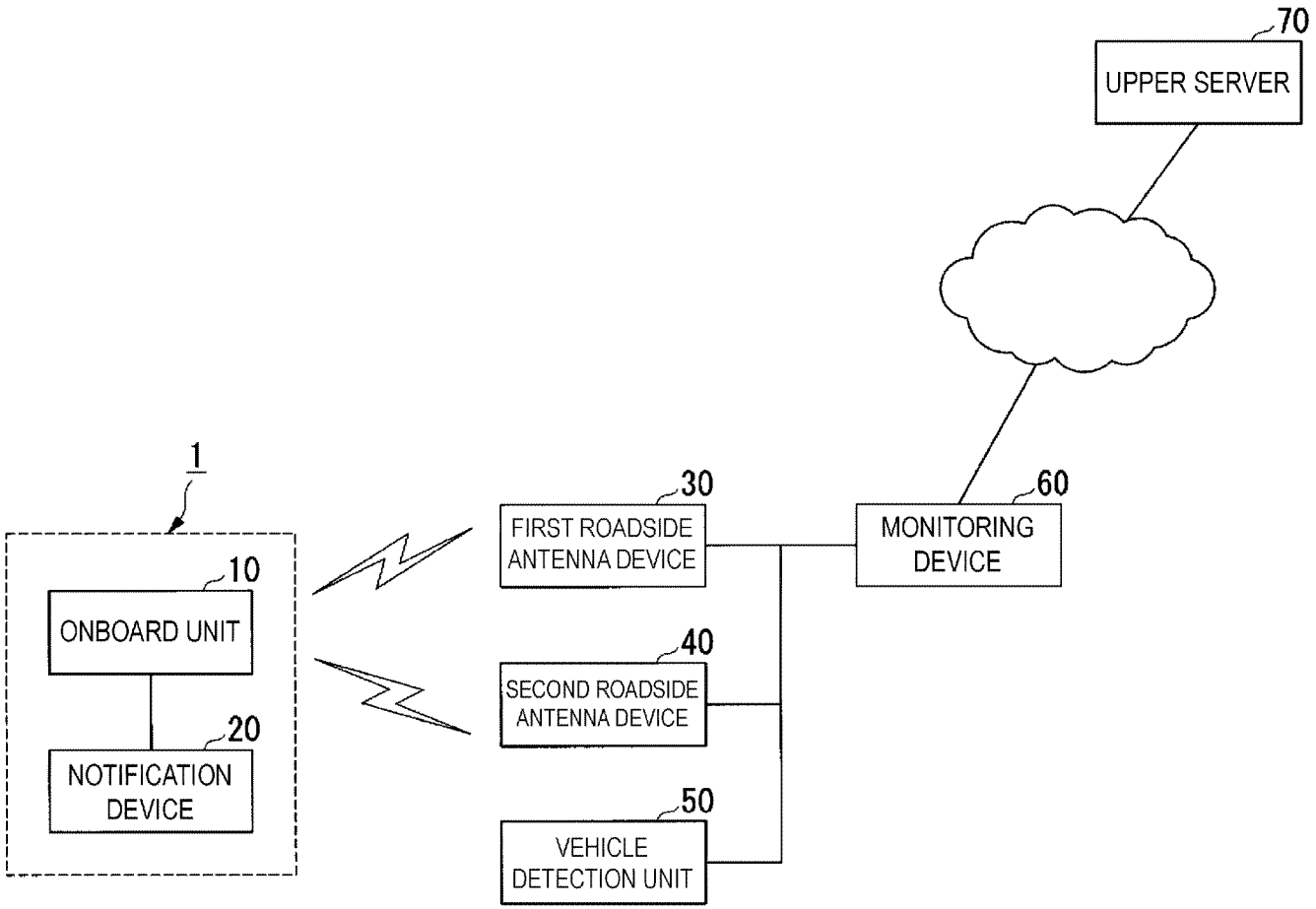
FIG. 2 is a block diagram illustrating an example of an overall system that includes the onboard system 1.

Moving to FIG. 2, an overall system (monitoring system) that includes the onboard system 1 will be described next. FIG. 2 is a block diagram illustrating an example of an overall system that includes the onboard system 1.

The onboard unit 10 communicates with a first roadside antenna device 30 and a second roadside antenna device 40 installed at the tollgate when the vehicle passes through a tollgate of a toll road, for example.

A vehicle detection unit 50 and a monitoring device 60 are also installed at the tollgate in addition to the first roadside antenna device 30 and the second roadside antenna device 40.

In this embodiment, the first roadside antenna device 30, the second roadside antenna device 40, and the vehicle detection unit 50 have a wired connection with the monitoring device 60. The monitoring device 60 is connected to an upper server 70 located away from the tollgate via a wide area network such as the Internet.

Tollgate

Figure 3:
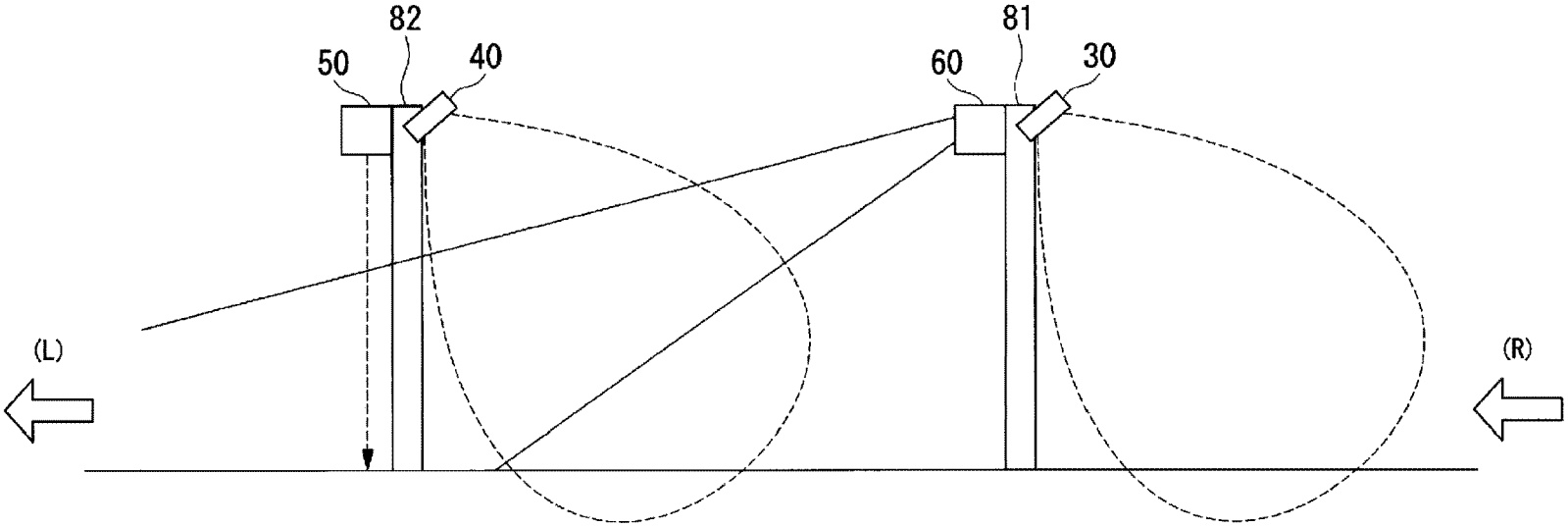
FIG. 3 is a schematic diagram illustrating an arrangement of devices installed at a tollgate.

Moving to FIG. 3, the devices installed at the tollgate will be described next. FIG. 3 is a schematic diagram illustrating an arrangement of devices installed at the tollgate.

FIG. 3 is a view of the tollgate as viewed from the side. The right side (R) is the side from which vehicles enter, and the left side (L) is the side from which vehicles exit.

On the roadside of the traffic lane, two gantries 81, 82 are installed, for example. The gantry 81 is installed on the entrance side, and the gantry 82 is installed on the exit side.

The first roadside antenna device 30 and the monitoring device 60 are installed on the gantry 81. The first roadside antenna device 30 communicates with the onboard unit 10 present in a predetermined communication area (the area indicated by a dotted line) on the entrance side. The monitoring device 60 captures an image of the vehicle present near the gantry 82.

The second roadside antenna device 40 and the vehicle detection unit 50 are installed on the gantry 82. The second roadside antenna device 40 communicates with the onboard unit 10 present in a predetermined communication area (the area indicated by a dotted line) on the side of the gantry 81 toward the exit. The vehicle detection unit 50 detects the vehicle present near the gantry 82.

Configuration of Onboard Unit 10 and Notification Device 20

Figure 4:
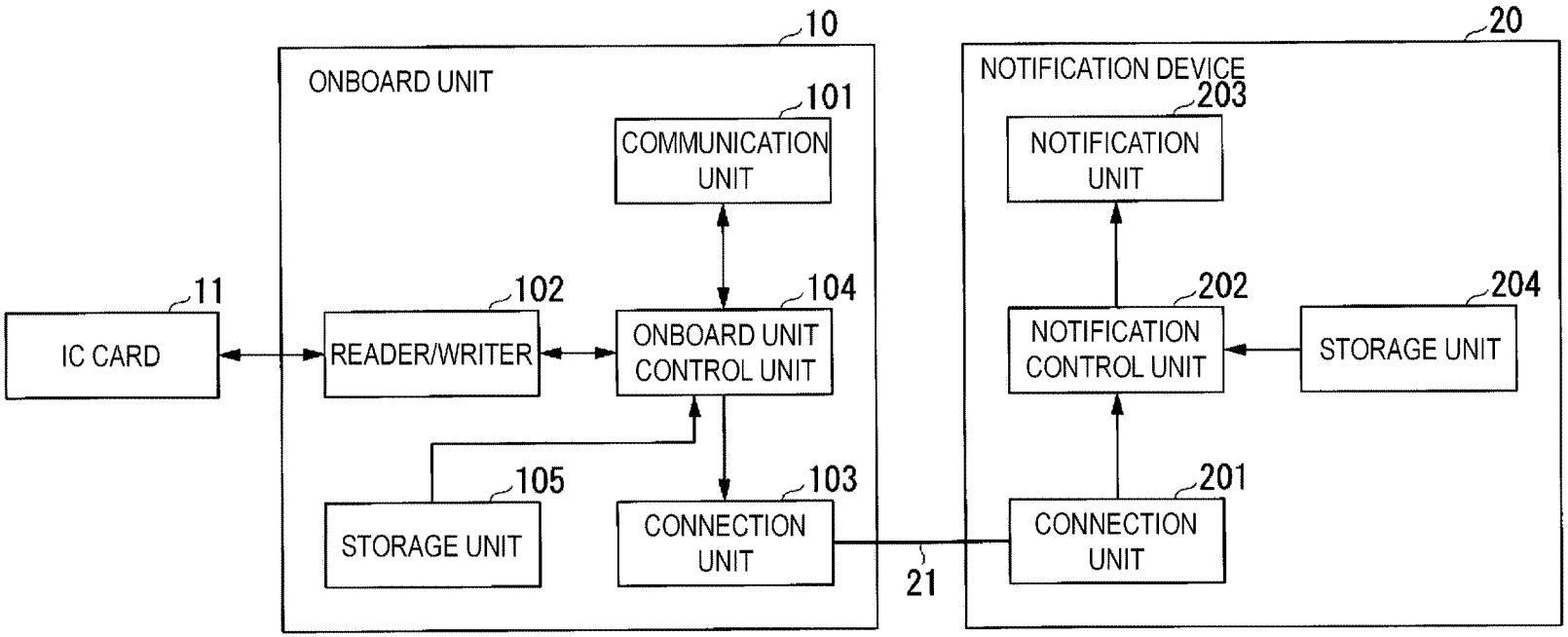
FIG. 4 is a block diagram illustrating an example of a configuration of an onboard unit 10 and a notification device 20.

Moving to FIG. 4, the configuration of the onboard unit 10 and the notification device 20 will be described next. FIG. 4 is a block diagram illustrating an example of a configuration of the onboard unit 10 and the notification device 20.

As illustrated in FIG. 4, the onboard unit 10 includes a communication unit 101, a reader/writer 102, a connection unit 103, an onboard unit control unit 104, and a storage unit 105. An IC card 11 is inserted into a predetermined card slot on the onboard unit 10.

The communication unit 101 receives entry information, commands, and the like from the first roadside antenna device 30 and the second roadside antenna device 40 via a narrow area network such as DSRC and transmits information and the like read from the IC card 11 and the storage unit 105.

The reader/writer 102 accesses the IC card 11 to read or write information. Note that entry information of a toll road or the like is recorded in the IC card 11.

Vehicle information related to the onboard unit 10 is recorded in the storage unit 105. Note that vehicle information includes information such as vehicle type, and vehicle registration number.

The connection unit 103 is connected to the notification device 20. In this embodiment, the connection unit 103 is an interface that electrically connects to a cable 21 that connects to the notification device 20. For example, when the onboard unit 10 is installed in a predetermined attachment position, the connection unit 103 and the cable 21 may be configured to establish an electric connection. Then, when the onboard unit 10 is removed, the electric connection between the connection unit 103 and the cable 21 is severed.

The onboard unit control unit 104 is a control unit that centrally controls the onboard unit 10 and is a central processing unit (CPU), for example. The onboard unit control unit 104 outputs the vehicle information read from the storage unit 105 to the notification device 20 via the connection unit 103, for example. Additionally, the onboard unit control unit 104 periodically outputs a signal like a heartbeat to the notification device 20 via the connection unit 103 at preset intervals.

The notification device 20 includes a connection unit 201, a notification control unit 202, a notification unit 203, and a storage unit 204.

The storage unit 204 stores vehicle information relating to the vehicle equipped with the notification device 20. Note that vehicle information includes information such as vehicle type, and vehicle registration number.

The connection unit 201 is connected to the onboard unit 10. In this embodiment, the connection unit 201 is electrically connected to the cable 21 that connects the onboard unit 10 and the notification device 20.

The notification control unit 202 monitors the connection status between the onboard unit 10 and the notification device 20 (whether or not they are connected) and controls the notification unit 203 to output a notification signal based on the connection status. In this embodiment, when the notification control unit 202 detects that the onboard unit 10 and the notification device 20 are not connected, the notification control unit 202 issues a command to the notification unit 203 to output a notification signal notifying that the onboard unit 10 has been disconnected. Accordingly, output of a notification signal means a not connected status, and no output of a notification signal means a connected status.

Note that the configuration is not limited to that described above. When the onboard unit 10 and the notification device 20 are connected, the notification control unit 202 may issue a command to the notification unit 203 to output a notification signal notifying that the onboard unit 10 is installed. In this case, output of a notification signal means a connected status, and no output of a notification signal means a not connected status.

Additionally, the notification control unit 202 compares the vehicle information stored in the storage unit 204 and the vehicle information received from the onboard unit 10. If the vehicle information does not match, the notification control unit 202 issues a command to the notification unit 203 to output a notification signal. In this embodiment, when the vehicle information stored in the storage unit 204 and the vehicle information received from the onboard unit 10 are different, for example, if one corresponds to a large car and the other to a small car, or the vehicle registration numbers are different, the notification control unit 202 issues a command to output a notification signal notifying that the onboard unit 10 has been switched. Additionally, if the vehicle information received from the onboard unit 10 is null, the notification control unit 202 issues a command to output a notification signal notifying that the onboard unit 10 has been disconnected. Depending on the notification details of the notification signal, the notification control unit 202 may change the output pattern for the notification signal. Such an output pattern for a notification signal corresponding to notification details may be set in advance.

The notification unit 203 may be an illumination device such as a light emitting diode (LED). When the notification unit 203 receives a notification signal from the notification control unit 202, the LED may light up or flash continuously. The LED may emit visible light, or may emit invisible light such as infrared light. Note that the notification unit 203 is not limited to the configuration described above and may output a sound or electromagnetic wave as the notification signal.

Configuration of Monitoring Device 60

Figure 5:
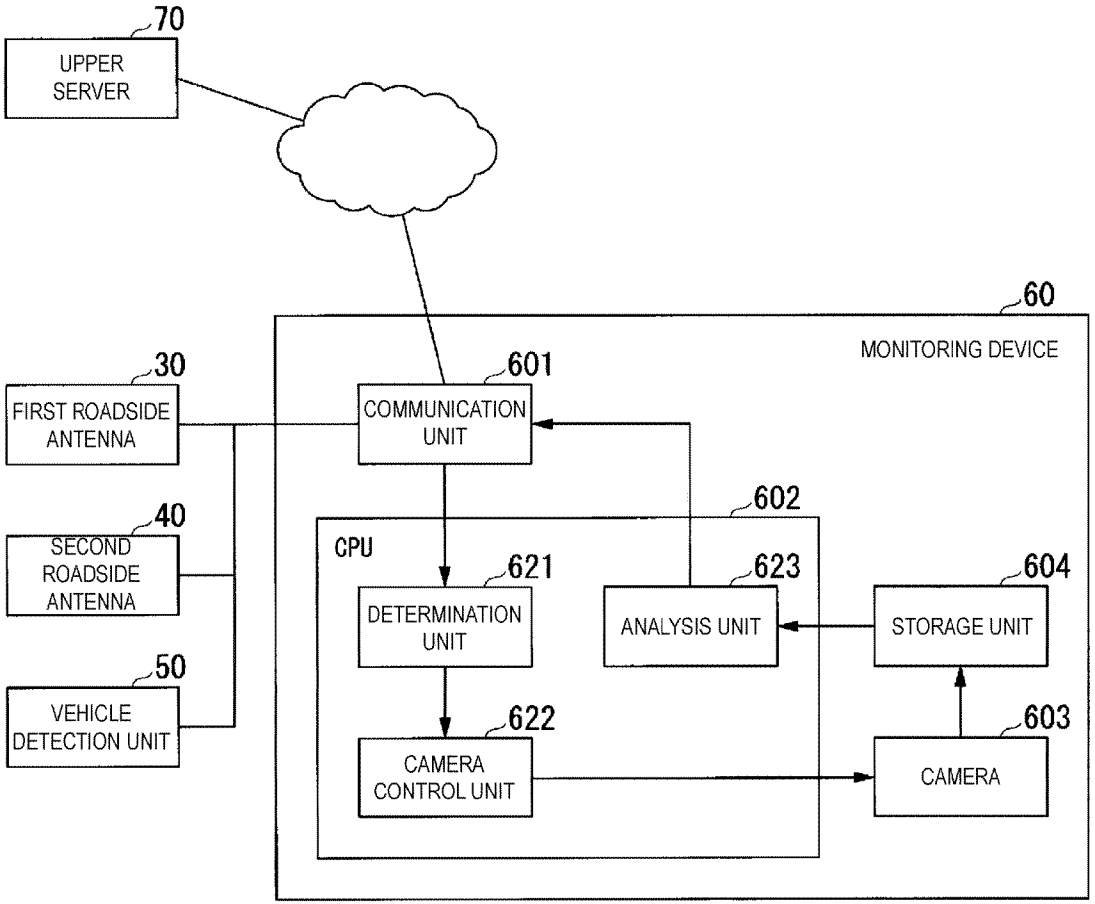
FIG. 5 is a block diagram illustrating an example of a configuration of a monitoring device 60.

Moving to FIG. 5, the configuration of the monitoring device 60 will be described next. FIG. 5 is a block diagram illustrating an example of a configuration of the monitoring device 60.

As illustrated in FIG. 5, the monitoring device 60 includes a communication unit 601, a CPU 602, a camera 603, and a storage unit 604.

The communication unit 601 is connected to the first roadside antenna device 30, the second roadside antenna device 40, and the vehicle detection unit 50 and outputs signals received therefrom to the CPU 602. Additionally, the communication unit 601 is connected to an upper server 70 via the Internet or the like and transmits information on the monitoring result from the monitoring device 60 to the upper server 70, for example.

The camera 603 captures an image of a vehicle present near the gantry 82 when a capture command is received from the CPU 602. The captured image is output to the storage unit 604 as image data. The camera 603 outputs the image data accompanied with information on the date which the image was captured and the like.

The storage unit 604 stores images captured by the camera 603.

The CPU 602 centrally controls the monitoring device 60. The monitoring device 60 includes a determination unit 621, a camera control unit 622, and an analysis unit 623 as functional units whose function is enabled by the execution of a program by the CPU 602. One or all of these functional units may be hardware functional units such as a large scale integration (LSI) or an application specific integrated circuit (ASIC).

The determination unit 621 determines whether or not a vehicle with non-functioning DSRC communication passed on the basis of a signal from the first roadside antenna device 30, the second roadside antenna device 40, and the vehicle detection unit 50. Note that a "vehicle with non-functioning DSRC communication" includes a vehicle for which the first roadside antenna device 30 or the second roadside antenna device 40 cannot obtain a communication result because an onboard unit 10 is not installed, and a vehicle which has an installed onboard unit 10 but with which the first roadside antenna device 30 or the second roadside antenna device 40 fail to establish communication.

In the present embodiment, the camera control unit 622 captures an image of all vehicles that pass it. Note that the configuration is not limited to that described above, and the camera control unit 622 may issue a command to instruct the camera 603 to capture an image of a passing vehicle with non-functioning DSRC communication per a determination by the determination unit 621.

The analysis unit 623 analyzes image data read from the storage unit 604, extracts number information on the license plate, and detect whether or not the notification device is emitting light. In the present embodiment, the analysis unit 623 determines whether or not the light of the notification device 20 of the vehicle in the image on or flashing. If the light of the notification device 20 of the vehicle in the image is determined to be on or flashing, this information is transmitted to the upper server 70 via the communication unit 601 accompanied with the image data.

Process Flow when Vehicle Passes the Tollgate

Figure 6:
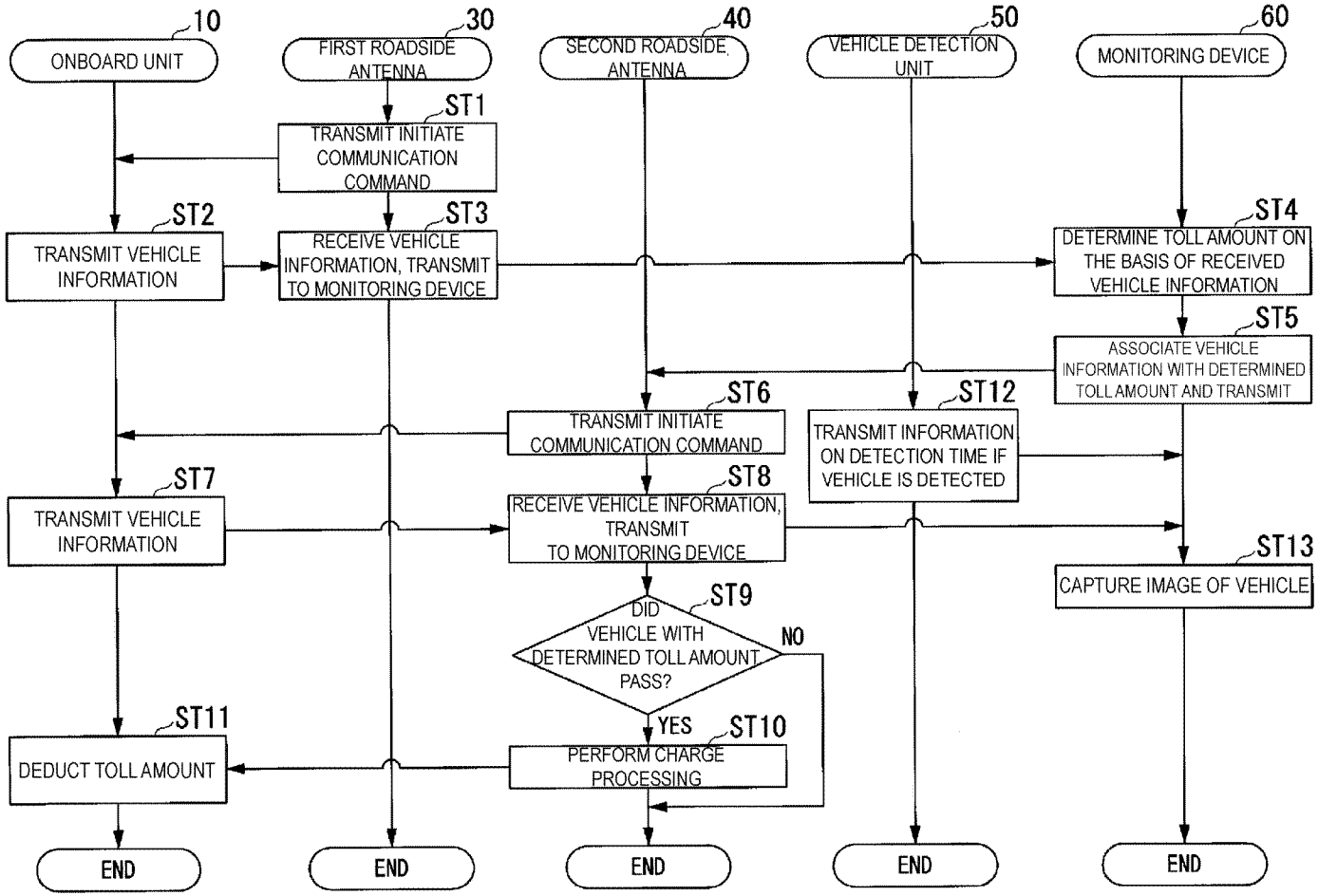
FIG. 6 is a flowchart for explaining an example of a process flow for when a vehicle passes the tollgate.

Moving to FIG. 6, the process flow when a vehicle passes the tollgate will be described next. FIG. 6 is a flowchart for explaining an example of a process flow for when a vehicle passes the tollgate.

When the vehicle enters the communication region of the first roadside antenna device 30, the onboard unit 10 of the vehicle receives an initiate communication command transmitted from the first roadside antenna device 30 (step ST1). The onboard unit 10 transmits a response command to the first roadside antenna device 30, and DSRC communication is established. When DSRC communication is established, the onboard unit 10 reads vehicle information from the storage unit 105 and transmits it to the first roadside antenna device 30 (step ST2). The first roadside antenna device 30 receives the vehicle information from the onboard unit 10 and in turn transmits the received vehicle information to the monitoring device 60 (step ST3). Here, the onboard unit 10 may transmit entry information read from the IC card 11 and the like to the monitoring device 60 via the first roadside antenna device 30.

The monitoring device 60 determines the toll amount on the basis of the received vehicle information and the entry information (step ST4). For example, the CPU 602 of the monitoring device 60 references a preset toll charge table on the basis of entry information and vehicle type information contained in the vehicle information, and determines the toll amount to the tollgate from the entry information according to the vehicle type information.

The CPU 602 of the monitoring device 60 associates the vehicle information with the information on the determined toll amount and transmits this to the second roadside antenna device 40 (step ST5). The second roadside antenna device 40 associates the vehicle information with the information on the received toll amount and stores this in its own storage unit.

Thereafter, when the vehicle enters the communication region of the second roadside antenna device 40, the onboard unit 10 receives an initiate communication command from the second roadside antenna device 40 (step ST6). The onboard unit 10 transmits a response command to the second roadside antenna device 40, and DSRC communication is established. When DSRC communication is established, the onboard unit 10 reads vehicle information from the storage unit 105 and transmits it to the second roadside antenna device 40 (step ST7). The second roadside antenna device 40 receives the vehicle information from the onboard unit 10 and in turn transmits the received vehicle information to the monitoring device 60 (step ST8).

The second roadside antenna device 40 determines whether or not the vehicle that owes the toll amount determined by the monitoring device 60 passed (step ST9). In the present embodiment, the second roadside antenna device 40 searches the vehicle information stored in its storage unit to see whether or not the vehicle information received from the onboard unit 10 in step ST8 matches it.

If the vehicle information read from the storage unit of the second roadside antenna device 40 matches the vehicle information received from the onboard unit 10, charge processing is performed on the basis of the vehicle information read from the storage unit and the associated information on the toll amount (step ST10). In the present embodiment, the second roadside antenna device 40 transmits the information on the toll amount to the onboard unit 10 and issues a command to deduct the toll amount.

The onboard unit 10 executes processing of deducting the toll amount from electronic money stored in the IC card 11 on the basis of the commands of the second roadside antenna device 40 (step ST11).

The vehicle detection unit 50 transmits information on the detection time and detection result to the monitoring device 60 when the vehicle is detected (step ST12).

The determination unit 621 of the monitoring device 60 captures an image of the vehicle detected by the vehicle detection unit 50 (step ST13).

Note that the determination unit 621 of the monitoring device 60 may determine whether or not a vehicle with non-functioning DSRC communication passed on the basis of a signal from the first roadside antenna device 30, the second roadside antenna device 40, or the vehicle detection unit 50. The determination unit 621, for example, determines whether or not vehicle information from the vehicle detected by the vehicle detection unit 50 was received via the first roadside antenna device 30 or the second roadside antenna device 40, and determines whether or not it is a vehicle with non-functioning DSRC communication on the basis of the determination results. If it has been determined that a vehicle with non-functioning DSRC communication passed, the camera control unit 622 of the monitoring device 60 may issue a command to the camera 603 to capture an image. The camera 603 captures an image under the command of the camera control unit 622 and stores the captured image in the storage unit 604.

Note that the determination unit 621 determines the timing period when the vehicle established DSRC communication with the first roadside antenna device 30 or the second roadside antenna device 40 on the basis of the detection time at which the vehicle is detected by the vehicle detection unit 50, speed of the vehicle, and the like. If vehicle information was received within the determined timing period, the determination unit 621 determines that vehicle information was received from the vehicle detected by the vehicle detection unit 50, or in other words that a communication result of DSRC communication was obtained. If it is determined that vehicle information is not received from the vehicle detected by the vehicle detection unit 50 via the first roadside antenna device 30 and/or the second roadside antenna device 40, the determination unit 621 determines that a vehicle with non-functioning DSRC communication has passed.

Process Flow of Notification Device 20

Figure 7:
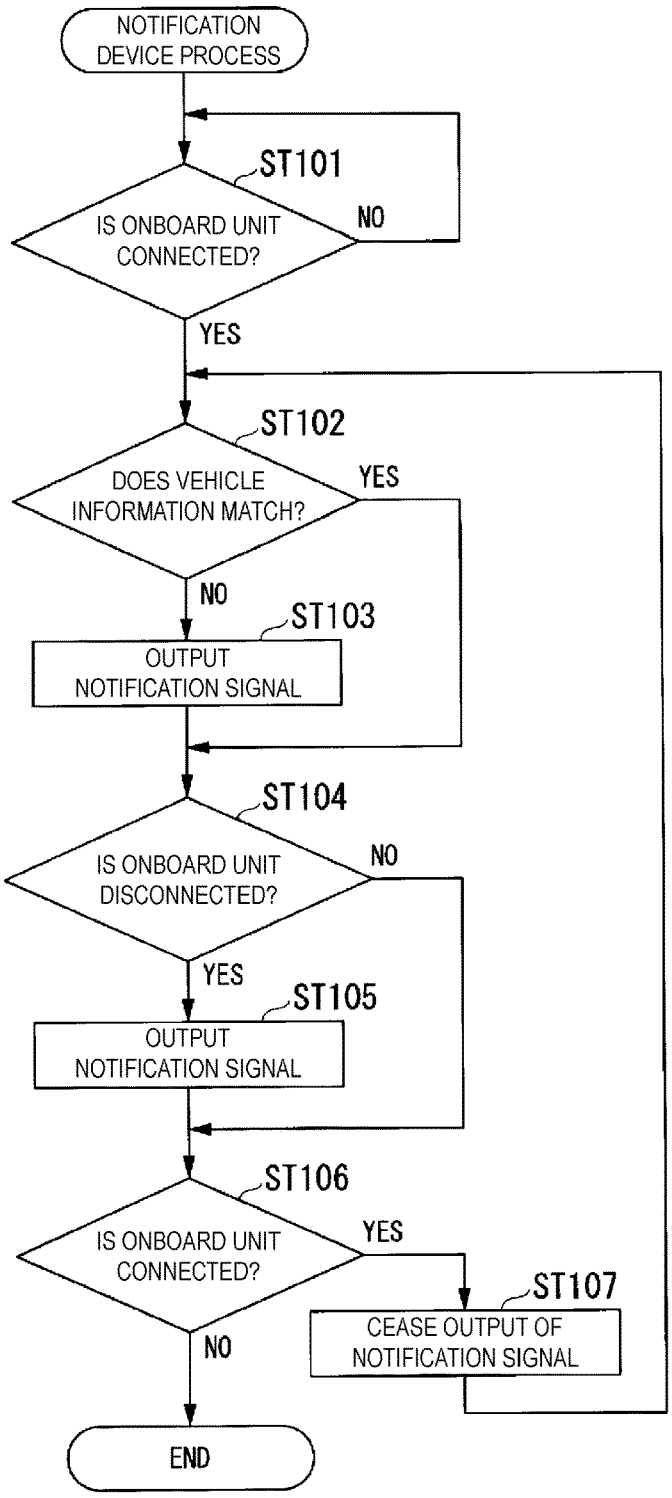
FIG. 7 is a flowchart for explaining an example of a process flow of the notification device 20.

Moving to FIG. 7, the process flow of the notification device 20 will be described next. FIG. 7 is a flowchart for explaining an example of a process flow of the notification device 20.

The notification control unit 202 determines whether or not it is connected to the onboard unit 10 (step ST101). For example, the notification control unit 202 determines whether or not it has received the signal (a signal like a heartbeat) regularly received from the onboard unit 10. If a heartbeat-like signal is received, the notification control unit 202 determines that it is connected to the onboard unit 10.

When it is determined that it is connected to the onboard unit 10, the notification control unit 202 compares the vehicle information stored in the storage unit 204 to the vehicle information received from the onboard unit 10 (step ST102).

If it is determined that the vehicle information does not match, the notification control unit 202 issues a command to the notification unit 203 to output a notification signal (step ST103). The LED of the notification unit 203 then lights up or flashes accordingly. If it is determined that the vehicle information does match, the notification unit 203 does not output a notification signal.

Next, the notification control unit 202 determines whether or not it is disconnected from the onboard unit 10 (step ST104). For example, the notification control unit 202 determines whether or not it has received a signal (a signal like a heartbeat) regularly received from the onboard unit 10. If the period of time the heartbeat-like signal is not received is greater than the length of the transmission intervals plus a predetermined period of time, the notification control unit 202 determines that it is disconnected from the onboard unit 10.

If it is determined that it is disconnected from the onboard unit 10, the notification control unit 202 issues a command to the notification unit 203 to output a notification signal (step ST105). The LED of the notification unit 203 then lights up or flashes accordingly. If it is determined that the vehicle information does match, the notification unit 203 does not output a notification signal. Here, the notification control unit 202 may output a signal different from the notification signal output in the step ST103, and communicate different notification details.

The notification control unit 202 determines whether or not it is connected to the onboard unit 10 (step ST106).

If it is determined that it is connected to the onboard unit 10, the notification control unit 202 issues a command to the notification unit 203 to cease output of the notification signal (step ST107). The LED of the notification unit 203 then turns off accordingly. Next, the process returns to step ST102.

Note that in the step ST102, if the vehicle information does not match, a connected status or a disconnected status with the onboard unit 10 can be determined. Thus, the process step ST104, ST105 may be omitted for the notification device 20.

Process Flow of Monitoring Device 60

Figure 8:
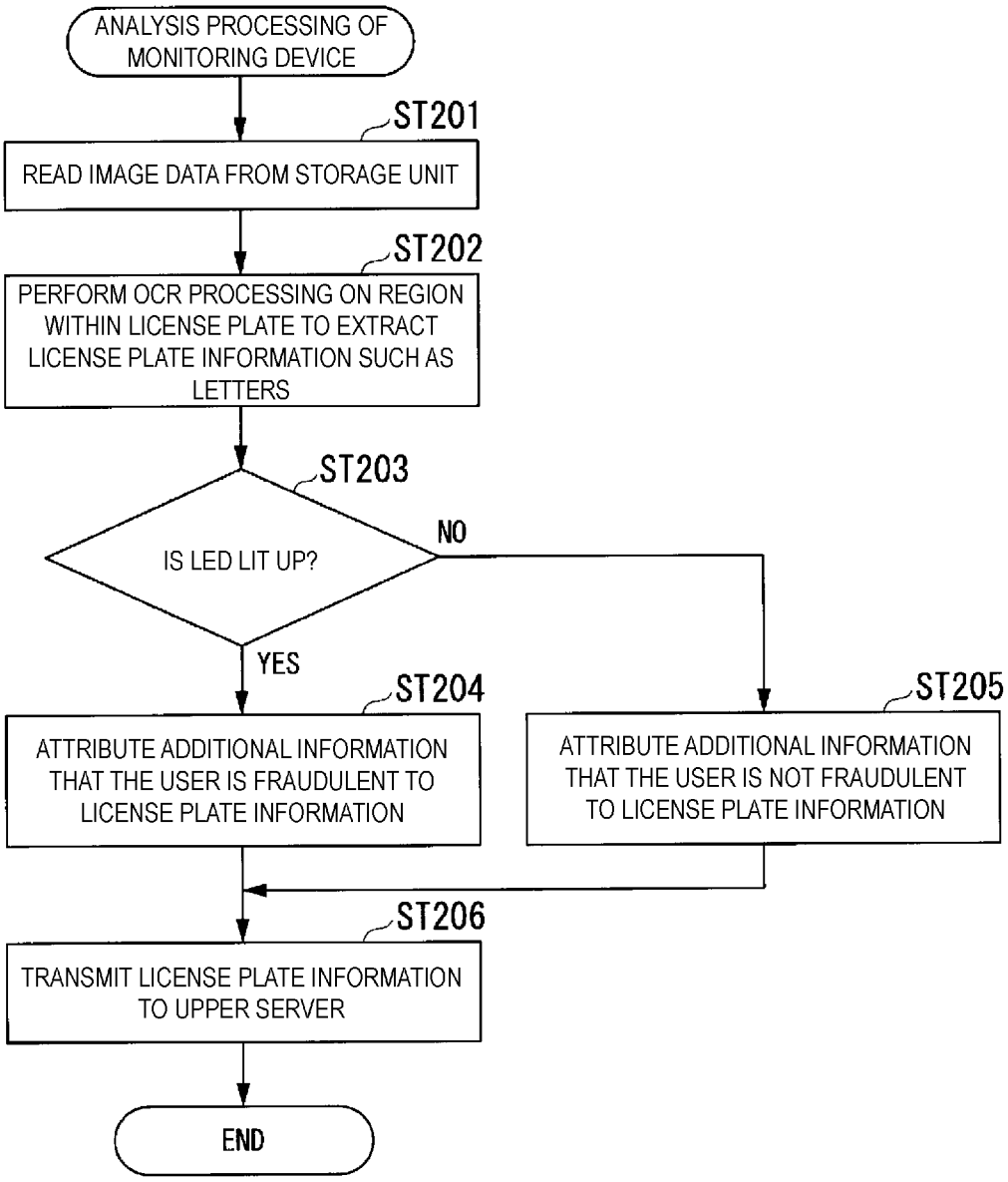
FIG. 8 is a flowchart for explaining an example of a process flow of the monitoring device 60.

Moving to FIG. 8, the process flow of the monitoring device 60 will be described next. FIG. 8 is a flowchart for explaining an example of a process flow of the monitoring device 60.

The analysis unit 623 of the monitoring device 60 reads image data from the storage unit 604 (step ST201).

The analysis unit 623 performs image processing on the read image data (step ST202). In the present embodiment, the analysis unit 623 uses image processing to determine an image region corresponding to the license plate within the image. The information of the letters and the like (hereinafter referred to as license plate information) are extracted by performing optical character recognition (OCR) on the image region of the license plate. Additionally, the analysis unit 623 searches for an illuminated portion of the notification unit 203 of the notification device 20 on the basis of brightness and luminance of the pixels determined by image processing (step ST203). Here, the analysis unit 623 may search for an illuminated portion on the basis of a positional relationship with the vehicle in the image in embodiments in which the notification device 20 has a preset position for installation in the vehicle.

If an illuminated portion is detected, the analysis unit 623 attributes additional information that the user is fraudulent to the license plate information (step ST204) and transmits the license plate information with this additional information to the upper server 70 via the communication unit 601 (step ST206).

If an illuminated portion is not detected, the analysis unit 623 attributes additional information that the user is not fraudulent to the license plate information (step ST205) and transmits the license plate information with this additional information to the upper server 70 via the communication unit 601 (step ST206).

Action and Effect

As described above, the onboard system 1 according to the present embodiment is configured to output a notification signal to an external device according to whether an expected onboard unit 10 is connected or not connected.

This configuration allows the notification signal output to an external device to be verified, and whether the expected onboard unit is connected or not connected to be identified.

This allows a vehicle with the onboard unit 10 disconnected to be distinguished from a vehicle unlike such from an image captured by the monitoring device 60. For example, a captured image of a vehicle with non-functioning DSRC communication can be used to distinguish a vehicle that fails in DSRC communication but has a normally attached onboard unit 10 from a fraudulent vehicle with a disconnected onboard unit 10. Thus, the accuracy of detecting fraudulent vehicle can be increased.

Additionally, an image captured by the monitoring device 60 can be used to discover vehicles without an expected onboard unit 10. For example, a captured image of a vehicle that succeeds in establishing DSRC communication can be used to distinguish a vehicle with an expected onboard unit 10 attached from a fraudulent vehicle with an unexpected onboard unit 10 attached. Thus, the accuracy of detecting fraudulent vehicle can be increased.

Furthermore, the onboard system 1 according to the present embodiment determines a connected status or a disconnected status with the onboard unit 10 on the basis of a signal (heartbeat-like signal or the like) regularly output from the onboard unit 10, and has the notification unit 203 output a notification signal on the basis of the determination result.

According to this configuration, whether there is a connected status or a disconnected status with the onboard unit can be easily determined.

Additionally, the onboard system 1 according to the present embodiment compares the vehicle information (second vehicle information) stored in the storage unit 204 of the notification device 20 and the vehicle information (first vehicle information) received from the onboard unit 10. If the vehicle information does not match, the notification unit 203 outputs a notification signal.

According to this configuration, if the first vehicle information and the second vehicle information do not match, a notification signal is output to an external device, thus allowing a fraudulent vehicle with an onboard unit from another vehicle to be discovered. For example, if an onboard unit 10 whose vehicle type information is that of a small vehicle has been switched into a large vehicle, the vehicle type information (large vehicle) stored in the notification device 20 and the vehicle type information (small vehicle)

obtained from the onboard unit 10 will not match. In this case, a notification signal is output, thus allowing fraudulent switching to be detected.

Additionally, according to this configuration, if there is no second vehicle information, a notification signal is output to an external device, thus allowing a fraudulent vehicle with a disconnected onboard unit to be discovered.

Furthermore, the onboard system 1 according to the present embodiment emits a light in a preset pattern as the notification signal.

According to this configuration, image processing or visual verification of light emitting in a preset pattern enables a fraudulent vehicle to be discovered. The place where verification of light emitting in a preset pattern enabling a fraudulent vehicle to be discovered is not limited to the tollgate where the roadside antenna device is installed. Furthermore, because a notification signal identifying the fraudulent vehicle is shown in the image of the fraudulent vehicle captured by the monitoring device 60. As a result, a fraudulent vehicle can be easily identified.

Additionally, the monitoring system according to the present embodiment includes the onboard unit system described above, and the monitoring device 60 that monitors a notification signal transmitted from the notification device 20.

According to this configuration, the output notification signal is monitored enabling a fraudulent vehicle without the onboard unit 10 to be easily discovered from multiple vehicles passing through a tollgate or charge point.

Furthermore, the monitoring device 60 of the monitoring system according to the present embodiment includes the camera 603. The camera 603 captures an image of a vehicle outputting a notification signal from the installed notification device 20.

According to this configuration, a fraudulent vehicle outputting a notification signal can be discovered on the basis of an image captured by the camera, and the captured image becomes evidence used to catch such vehicles with no onboard unit 10 or a switched unexpected onboard unit 10.

Additionally, the monitoring system according to the present embodiment detects whether or not the notification device 20 is emitting a light from the image captured by the camera 603.

According to this configuration, the fraudulent vehicles without the onboard unit 10 or a switched unexpected onboard unit 10 can be extracted from the captured image. As a result, the work involved in catching fraudulent vehicles is reduced.

Furthermore, the monitoring system according to the present embodiment extracts number information of the vehicle from the image captured by the camera 603. Number information extracted from an image captured when a notification signal from the notification device 20 is detected can be obtained as information for identifying a fraudulent vehicle.

According to this configuration, a fraudulent vehicle without the onboard unit 10 or a fraudulent vehicle with a switched unexpected onboard unit 10 can be identified from the number information. This number information can be made into a database and managed so as to reduce the work involved in catching fraudulent vehicles.

Additionally, the monitoring system according to the present embodiment determines whether or not a vehicle that passes is a vehicle with non-functioning DSRC communication, captures an image of a vehicle determined to be a vehicle with non-functioning DSRC communication.

According to this configuration, the number of images captured by the monitoring device 60 can be controlled, and storage area and communication load associated with storing the image data can be reduced. Furthermore, an image of a vehicle in which the onboard unit 10 is connected but charge processing cannot complete due to non-functioning DSRC communication can be captured.

Second Embodiment

The onboard system 1 according to the present embodiment is not limited to the charging system executed by the charge processing via DSRC communication described above. An autonomous charging system described below with reference to FIG. 9 may be employed.

Figure 9:
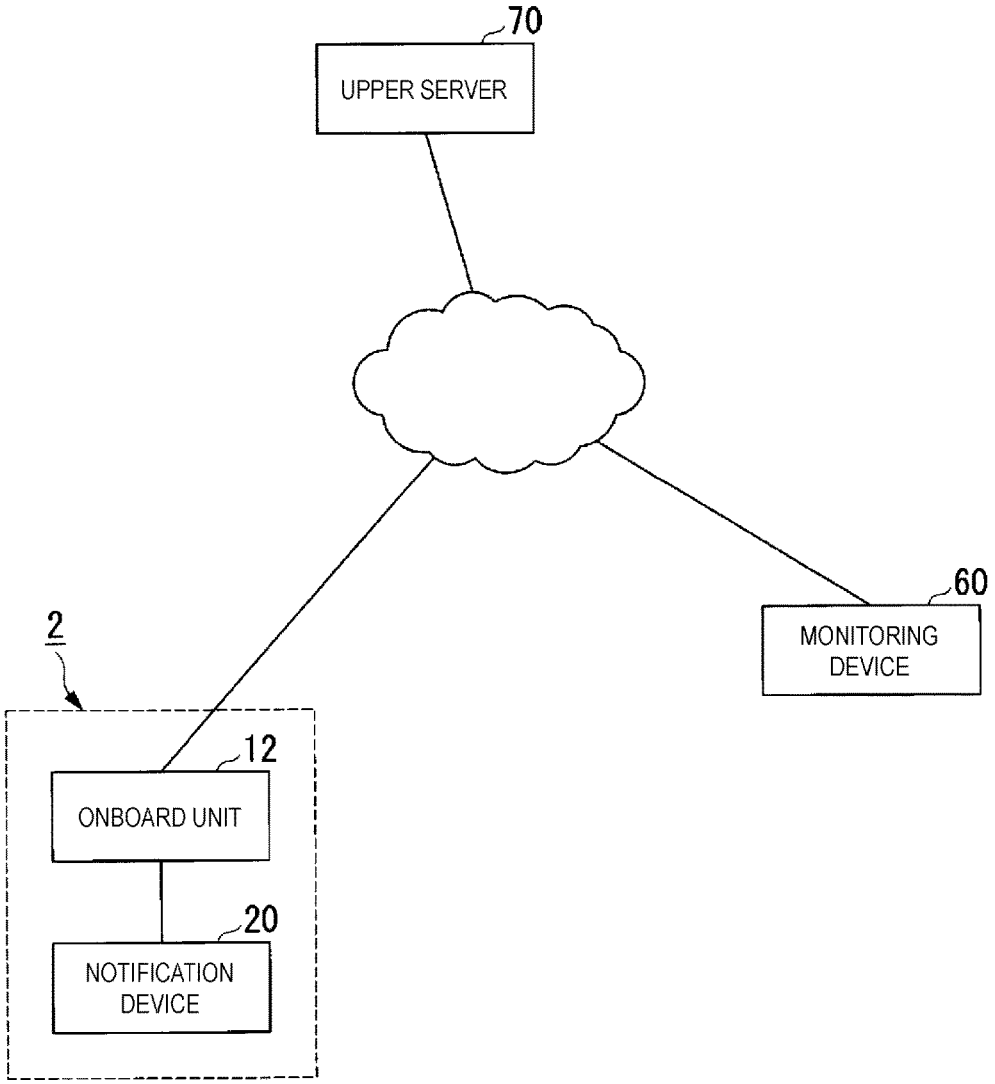
FIG. 9 is a schematic diagram of an example of an onboard system 1 to which an autonomous charging system is applied.

FIG. 9 is a schematic diagram of an example of an onboard system 1 to which an autonomous charging system is applied. As illustrated in FIG. 9, the autonomous charging system includes an onboard system 2, the monitoring device 60, and the upper server 70. Compared to the first embodiment, this embodiment differs in that the components (the first roadside antenna device 30, the second roadside antenna device 40, and the vehicle detection unit 50) at the tollgate are not provided.

The onboard system 2 include an onboard unit 12 and the notification device 20. Note that the notification device 20 is the same as that of the first embodiment. The same reference sign is used and an explanation thereof is omitted.

The onboard unit 12 is connected to the monitoring device 60 and the upper server 70 via a wide area network such as the Internet.

The onboard unit 12 is installed in a vehicle and obtains positional information of the vehicle via the global navigation satellite system (GNSS). The onboard unit 12, for example, refers to navigational information stored in its storage unit, and determines whether or not the vehicle has passed a preset charge point on the basis of the obtained positional information. If it is determined that the vehicle passed the charge point, the onboard unit 12 performs charge processing on the basis of information read from the IC card 11. The onboard unit 12 transmits the result of the charge processing to the monitoring device 60 and the upper server 70.

The monitoring device 60 is installed at the charge point and captures images of vehicles passing the charge point. The monitoring device 60 image processes captured images and detects passing vehicles. If the monitoring device 60 does not receive a result of the charge processing from the onboard unit 12 of a vehicle, that vehicle is treated as a "vehicle with non-functioning DSRC communication" as described in the first embodiment.

In such a manner, in a system without a roadside antenna, the notification device 20 outputs a notification signal identifying a fraudulent vehicle. Thus, fraudulent vehicles can be caught without DSRC communication.

Substitution and Changing of Components

In addition, the constituent elements in the embodiments as described above can be replaced as appropriate with commonly known constituent elements, to the extent that it does not deviate from the intention of the present invention. Also the technical scope of the present invention is not limited to the embodiments described above, and various modifications may be further made without deviating from the spirit of the present invention.

For example, the notification device 20 may output a light in a preset pattern as the notification signal. Examples of patterns include flashing and flashing at a certain or determined intervals.

In such embodiments, the notification device 20 preferably adjusts the intervals of the flashes in accordance with the intervals in which images are captured by the camera 603 (number of frames and the like) so that the flashing light is able to be captured by the camera 603.

When the notification device 20 is flashing, the monitoring device 60 can detect a plurality of captured images that include an illuminated portion from a plurality of images successively captured to determine whether the vehicle is outputting a notification signal. Additionally, when the light is flashing in determined intervals, by the timing of detection of the plurality of captured images that include an illuminated portion matching the flashing intervals, it can be determined that the vehicle is outputting a notification signal.

According to this configuration, the vehicle outputting the notification signal from the notification unit 203 can be distinguished and detected from illuminated portions detected from reflections and the like in the evening.

Furthermore, the notification unit 203 of the notification device 20 is not limited to being disposed on the outside and upper portion of the vehicle and may be an LED attached to the license plate, for example. In such embodiments, one or a plurality of LEDs may be disposed. For example, LEDs may be attached to the four corners of a rectangular license plate.

According to the configuration, the image processing of detecting the illuminated portion of the notification unit 203 from the captured image can be performed in concert with image processing to extract the vehicle registration number.

Additionally, as described above, in embodiments in which LEDs are attached to the four corners of the license plate, the four LEDs may light up in order. In such embodiments, if four images are captured in which each of the four LEDs on the corners are lit up, it can be determined that a notification signal is being output.

Furthermore, the monitoring device 60 described above extracts images of the outputting notification signal from images captured by the camera 603, however the process is not limited thereto. All of the images may be transmitted to the upper server 70. In such embodiments, the image of a vehicle with a lit up LED may be extracted visually by a user operating the upper server 70.

Additionally, an observer may visually verify vehicles outputting a notification signal, find the fraudulent vehicle, and catch the fraudulent vehicle on the spot.

The notification device 20, for example, may include a communication unit for connecting to the Internet and the like. In such embodiments, if it is determined that the notification device 20 and the onboard unit 10 are in a disconnected status, the notification device 20 may transmit the vehicle information and a warning signal to the upper server 70 via the Internet. According to this configuration, the upper server 70 can verify that the onboard unit 10 has been disconnected.

Additionally, the onboard units 10, 12 are described as deducting the toll amount from the IC card 11, however the configuration is not limited thereto. For example, charge processing may be performed on the upper server 70 side via Internet communication or the like.

Furthermore, the onboard units 10, 12 are described as performing charge processing. However, the configuration is not limited thereto, and are only required to perform vehicle traffic processing. For example, to detect the position of the vehicle, the onboard units 10, 12 may transmit vehicle information and positional information to the first and second roadside antenna devices 30, 40 and/or the upper server 70.

Additionally, the analysis unit 623 provided in the monitoring device 60 may be a function on the upper server 70 side.

The onboard units 10, 12 are described as reading vehicle information from the storage unit 105 of the onboard unit 10, however the configuration is not limited thereto. For example, the onboard units 10, 12 may read vehicle information stored in the IC card 11 and transmit this information to a roadside antenna or the like.

Furthermore, the systems according to the first and second embodiments may be employed in environments where it is difficult to catch fraudulent vehicles such as a facility without a gate or the like that lets through only vehicles with completed charge processing.

The onboard unit control unit 104 is described as regularly outputting a heartbeat-like signal or the like to the notification device 20 at a preset interval, however the configuration is not limited thereto. The onboard unit control unit 104 may output the signal in an irregular manner. The interval at which the signal is output may also be not fixed. For example, the onboard unit control unit 104 may irregularly output a preset number of signals within a certain period of time. The notification device 20 determines that the onboard unit 10 is disconnected when the preset number of signals is not received within the certain period of time.

Additionally, the notification device 20 is described as determining the connection status with the onboard unit 10 on the basis of a signal from the onboard unit control unit 104, however the configuration is not limited thereto. For example, the notification device 20 may have a primary battery, in an embodiment in which the primary power source is acquired from the onboard unit 10, the notification device 20 may determine the connection status with the onboard unit 10 on the basis of a change in the power source voltage from the onboard unit 10.

Furthermore, the notification control unit 202 is described as comparing the vehicle information stored in the storage unit 204 and the vehicle information received from the onboard unit 10 and issuing a command to output a notification signal to the notification unit 203 when the vehicle information does not match. In some embodiments, for this process, the vehicle information may not be stored in the onboard unit 10, and vehicle information from the onboard unit 10 may not be received from the onboard unit 10.

REFERENCE SIGNS LIST

1 Onboard system
10 Onboard unit
11 IC card
20 Notification device
21 Cable
30 First roadside antenna device
40 Second roadside antenna device
50 Vehicle detection unit
60 Monitoring device
70 Upper server
81 Gantry
82 Gantry
101 Communication unit
102 Reader/writer
103 Connection unit

104 Onboard unit control unit
105 Storage unit
201 Connection unit
202 Notification control unit
203 Notification unit
204 Storage unit
601 Communication unit
602 CPU
603 Camera
604 Storage unit
621 Determination unit
622 Camera control unit
623 Analysis unit

The invention claimed is:

1. An onboard system installed in a vehicle that performs traffic processing for the vehicle, the onboard system comprising:

an onboard unit that communicates with an external device to perform charge processing; and a notification device that outputs a notification signal to the external device according to whether an expected onboard unit is connected to the notification device via a connection unit or the expected onboard unit is disconnected from the notification device via the connection unit.

2. The onboard system according to claim 1, wherein the notification device determines a connected status with the onboard unit or a disconnected status with the onboard unit on the basis of a signal regularly outputted from the onboard unit, and outputs the notification signal on the basis of a determination result.

3. The onboard system according to claim 1, wherein the notification device stores first vehicle information on the vehicle, and compares the first vehicle information with second vehicle information stored in the onboard unit and outputs the notification signal to an external device if the first and second vehicle information do not match.

4. The onboard system according to claim 1, wherein the notification device emits a preset pattern of light as the notification signal.

5. A monitoring system, comprising:

the onboard system according to claim 1; and a monitoring device that monitors a notification signal emitted from the notification device of the onboard system.

6. The monitoring system according to claim 5, wherein the monitoring device comprises a camera that captures an image of the vehicle equipped with the notification device that is outputting the notification signal.

7. The monitoring system according to claim 6, wherein the monitoring device detects whether or not the notification device is emitting a light from an image captured by the camera.

8. The monitoring system according to claim 6, wherein the monitoring device extracts number information of the vehicle from an image captured by the camera, and the notification signal from the notification device is detected as information to identify a fraudulent vehicle.

* * * * *